US010689182B1

(12) United States Patent
Thompson

(10) Patent No.: US 10,689,182 B1
(45) Date of Patent: Jun. 23, 2020

(54) MULTI-COMPARTMENT DISPOSABLE POUCH

(71) Applicant: Jonathon L. Thompson, Boyne City, MI (US)

(72) Inventor: Jonathon L. Thompson, Boyne City, MI (US)

( * ) Notice: Subject to any disclaimer, the term of this patent is extended or adjusted under 35 U.S.C. 154(b) by 0 days.

(21) Appl. No.: 16/032,923

(22) Filed: Jul. 11, 2018

Related U.S. Application Data

(60) Provisional application No. 62/531,664, filed on Jul. 12, 2017.

(51) Int. Cl.
*B65D 81/32* (2006.01)
*B65D 30/22* (2006.01)
*B65F 1/00* (2006.01)

(52) U.S. Cl.
CPC ..... *B65D 81/3266* (2013.01); *B65D 31/12* (2013.01); *B65F 1/0006* (2013.01)

(58) Field of Classification Search
CPC ..... B65D 81/3266; B65D 31/12
USPC ..... 383/38
See application file for complete search history.

(56) References Cited

U.S. PATENT DOCUMENTS 2,015,972 A * 10/1935 Sodergren ..... B65D 31/12 206/568
2,344,369 A * 3/1944 Salfisberg ..... B65D 31/04 383/109
3,391,047 A 7/1968 Kopp
3,469,768 A 9/1969 Repko
3,891,138 A * 6/1975 Glas ..... B65D 31/12 206/219
4,629,080 A * 12/1986 Carveth ..... A61J 9/00 206/219
5,111,934 A * 5/1992 Morin ..... A47K 7/03 15/104.94
5,845,463 A 12/1998 Henaux
5,967,308 A 10/1999 Bowen
6,883,295 B1 * 4/2005 Negri ..... B29C 51/267 53/459
8,602,246 B2 12/2013 Frohwein
2003/0213213 A1 11/2003 Millon et al.
2006/0023974 A1 * 2/2006 Zimmerman ..... B65D 31/12 383/38
2019/0152667 A1 * 5/2019 Binder ..... B65D 75/327

FOREIGN PATENT DOCUMENTS

CN 106241020 A * 12/2016
EP 2567898 A1 3/2013
WO WO-2010080067 A1 * 7/2010 ..... B65D 81/3261

OTHER PUBLICATIONS

Machine translation of CN-106241020-A.*

* cited by examiner

*Primary Examiner* — Jes F Pascua
(74) *Attorney, Agent, or Firm* — Northern Michigan Patent Law, PLC

(57) ABSTRACT

A multi-compartment disposable pouch or sachet for independently accessing multiple items stored in the compartments independently from opposite ends of the pouch.

2 Claims, 4 Drawing Sheets

MULTI-COMPARTMENT DISPOSABLE POUCH

RELATED APPLICATIONS/PRIORITY BENEFIT CLAIM

This application claims the benefit of U.S. Provisional Application No. 62/531,664, filed Jul. 12, 2017 by the same inventor (Thompson), the entirety of which provisional application is hereby incorporated by reference.

FIELD

The subject matter of the present application is in the field of disposable multi-compartment pouches.

BACKGROUND

Disposable multi-compartment pouches are known for conveniently storing different materials or goods in separate compartments. Examples include those shown in U.S. Pat. No. 3,391,047 to Kopp (dual-compartment sachets for separate components of mixed adhesive compound); U.S. Pat. No. 3,469,768 to Repko (dual compartment container made from four plies of continuous, sealable web material); U.S. Pat. No. 8,602,246 to Frohwein (dual chamber container with independent or combined access to individual chambers, made from a blank folded into a triangular body with removable access "fins"); and, U.S. Pub. App. No. 2003/0213213 A1 (dual chamber sachet with a dispensing outlet attached to chamber divider wall).

Prior multi-chamber or multi-compartment pouches or sachets (hereafter generally "pouch") are believed to be overly complicated, material heavy, and somewhat difficult to use in terms of independently accessing the contents in separate compartments. These shortcomings can be significant where it is desired to access inexpensive, disposable, consumable items at different times or in a particular sequence from the pouch compartments.

Examples of such inexpensive consumable items include hygiene aids such as moistened or treated wipes or creams packaged in their own single-use foil packets, and complementary or extra items such as moisturizing lotions, drying cloths, and additional treated wipes or creams, without limitation, where one item is accessed and used first, and a second item is accessed and used subsequently. Even where such consumable items are contained in their own individual packets or containers, the addition of a tough, disposable, inexpensive pouch around the packet or container can prolong storage life, protect against the packet or container being breached prematurely by rough handling and storage conditions, and provide an elegant way to organize multiple stored consumable items.

BRIEF SUMMARY

The present invention is an inexpensive, simple, durable, convenient multi-compartment pouch for storing multiple consumable items in separate compartments, the compartments independently accessed by tearing or cutting or otherwise removing opposite end portions of the pouch.

In a first form, the multi-compartment pouch comprises two outer walls and at least one inner divider wall whose upper and lower ends are sealed to different-length portions of inside faces of the upper and lower ends of a respective outer wall. "Upper" and "lower" are used relatively, regardless of pouch orientation, to denote opposite ends (or sides) of the pouch from which the contents are removed.

In a further form, the pouch comprises two inner divider walls each with a lower end sealed over a first longer seal interface region of an inside face of a respective one of the outer wall lower ends, defining a lower end opening for an inner compartment. Each inner divider wall has an upper end sealed over a second shorter end seal region of an inside face of a respective one of the outer wall upper ends. The inner wall upper ends are further sealed to one another over a third longer seal interface region of greater length than the second shorter end seal region, defining two upper end openings for two outer compartments.

The lower and upper ends of the pouch are removable or openable in known fashion, for example with weakened tear lines or notches, or portions designated to be separated by pulling them apart or marked to be cut away.

The compartments in the pouch may be used to store any known consumable items, including but not limited to wipes, lotions, gels, granular materials, liquids, food products, hygienic products, and medicines. The consumable items may be individually packaged prior to being inserted and sealed in the pouch compartments; or, they may be unpackaged or loose in the pouch compartments, with the pouch walls being the only seal between the consumable items and the environment.

These and other features and advantages of the invention will become apparent from the detailed description below, in light of the accompanying drawings.

DETAILED DESCRIPTION

Figure 1:
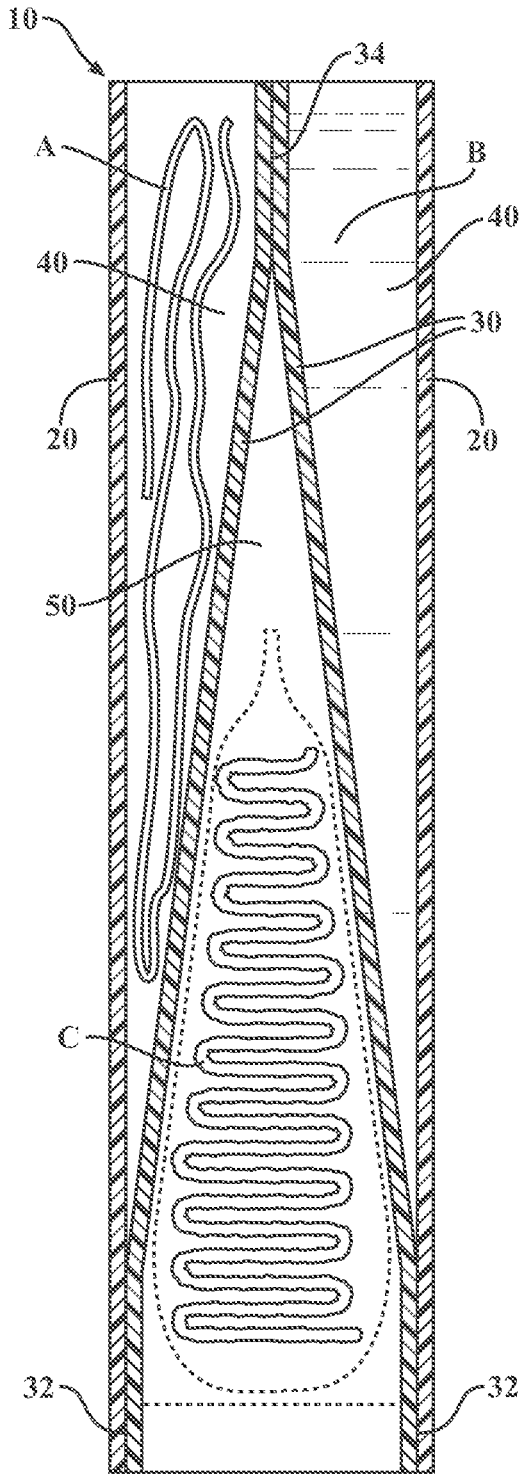
FIG. 1 is a side section view of a three-compartment pouch according to the invention.
Figure 2:
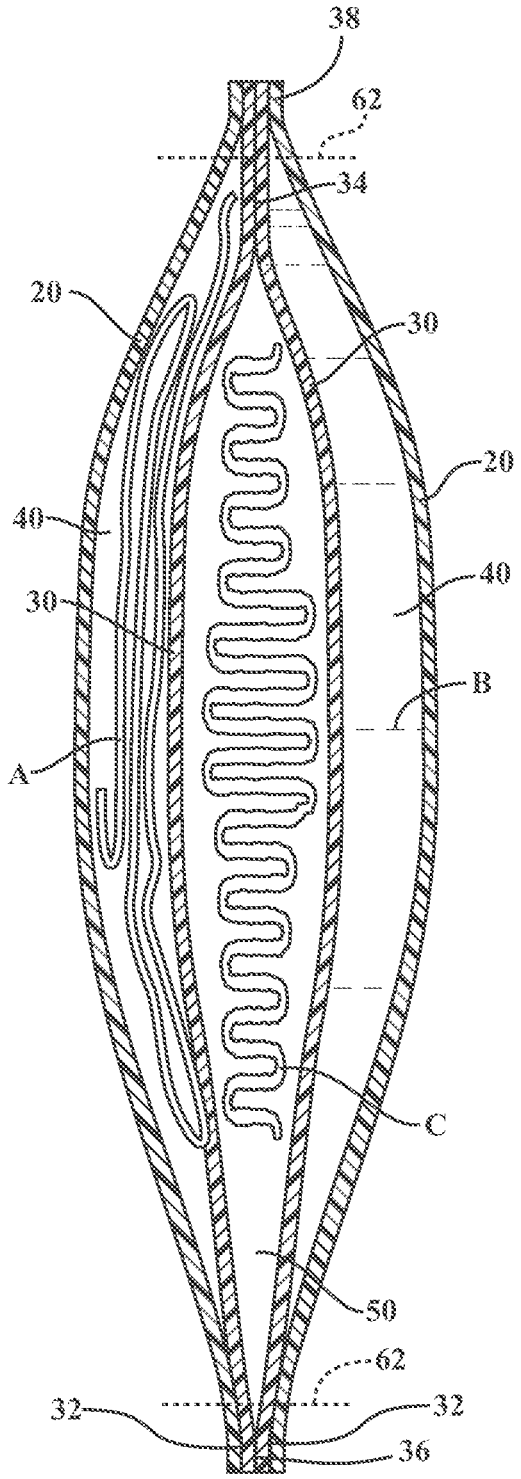
FIG. 2 is a similar to FIG. 1, but showing the upper and lower ends of the pouch sealed together.

Referring first to FIGS. 1 and 2, a pouch 10 is shown in exemplary form in order to teach how to make and use the claimed invention. Pouch 10 is preferably made from a thin, flexible, transparent material of a type known for use in disposable sachets, polybags, plastic bags and the like, such as but not limited to plastic film, nonwoven fabric, or plastic textile, often including polyethylene as a main component. While a transparent and waterproof material is preferred, materials of varying translucency and/or waterproofness/breathability/permeability may be used, depending on the contents being stored in the pouch and the expected storage environment. It would also be possible to use metal foil or paper materials, with or without transparent "window" portions for viewing the contents of the compartments in the pouch.

Pouch 10 has outer walls 20 and inner divider walls 30 to define three chambers or compartments: two outer compartments 40 opening onto the upper end of the pouch, and an inner compartment 50 opening onto the lower end of the pouch.

As shown in FIG. 1, the lower ends of inner divider walls 30 are joined or sealed to respective inner faces of the lower ends of outer walls 20 over an elongated interior seal interface 32. The upper ends of inner divider walls 30 are sealed to one another over an elongated interior seal interface 34. This initially forms pouch 10 sufficiently to define compartments 40 and 50 opening at the upper and lower ends of the pouch, respectively. Consumable items such as a dry tissue A, a lotion or gel B, and a foil-packaged moistened wipe C are inserted in compartments 40 and 50, either simultaneously or after the compartments have been formed, depending on the preferred manufacturing process, of which there are different types available and known to those skilled in the art of making disposable sachets and the like. The connections or seals between the outer walls 20 and inner walls 30 can likewise be made in any known manner, for example by heat sealing if using plastic material.

As shown in FIG. 2, once the consumable items A, B, and C are in their respective compartments, the lower and upper ends of pouch 10 are joined or sealed at 36 and 38 to the respective ends and faces of the inner divider wall 30. Lower and upper end seals 36 and 38 are shorter in length than their associated lower and upper elongated seal interfaces 32 and 34, so that a tear line, cutaway portion, or other opening feature 62 made across the upper and lower ends of the pouch can be used to open the respective lower or upper compartment end(s) without destroying the interior compartment seal interfaces 32 and 34.

Figure 3:
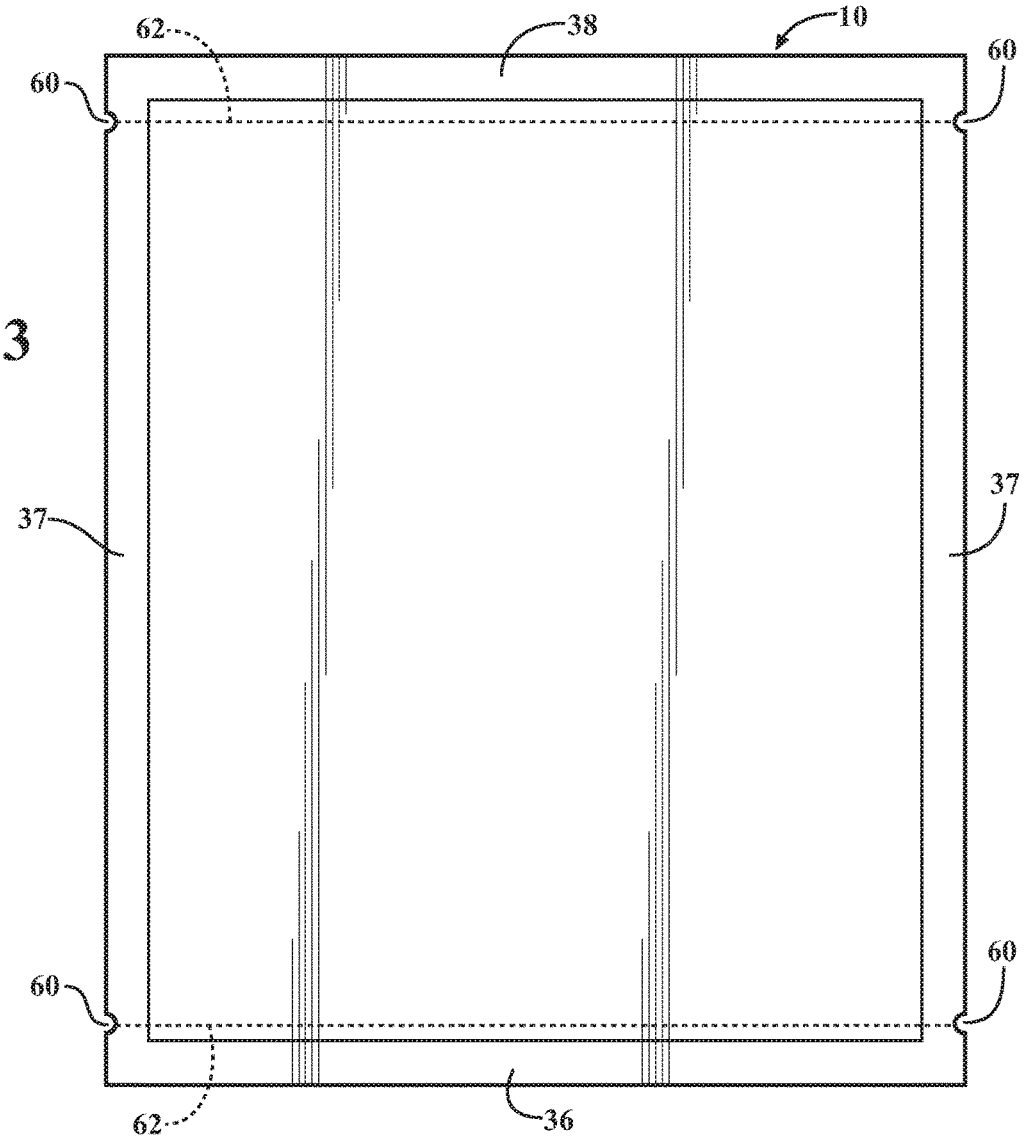
FIG. 3 is a front elevation view of the pouch of FIG. 1, showing tear notches and lines.

FIG. 3 shows pouch 10 as having a slightly elongated rectangular shape with a height between lower and upper sealed ends 36, 38 greater than its width between the sealed side edges 37. However, it should be understood that the shape and relative dimensions of the pouch may vary, provided it has opposite ends capable of being opened independently by removing or opening a respective sealed end portion. FIG. 3 shows tear notches 60 formed in the side edges 37 of the pouch near the lower and upper ends 36, 38, with a visibly marked or weakened tear or cut line 62 schematically shown extending across the pouch above and below the lower and upper end seals 36, 38, respectively. Side edges 37 are joined or sealed in a manner similar to that of lower and upper ends 36 and 38, but are not provided with any easy-opening features as they are intended to remain sealed.

Figure 4:
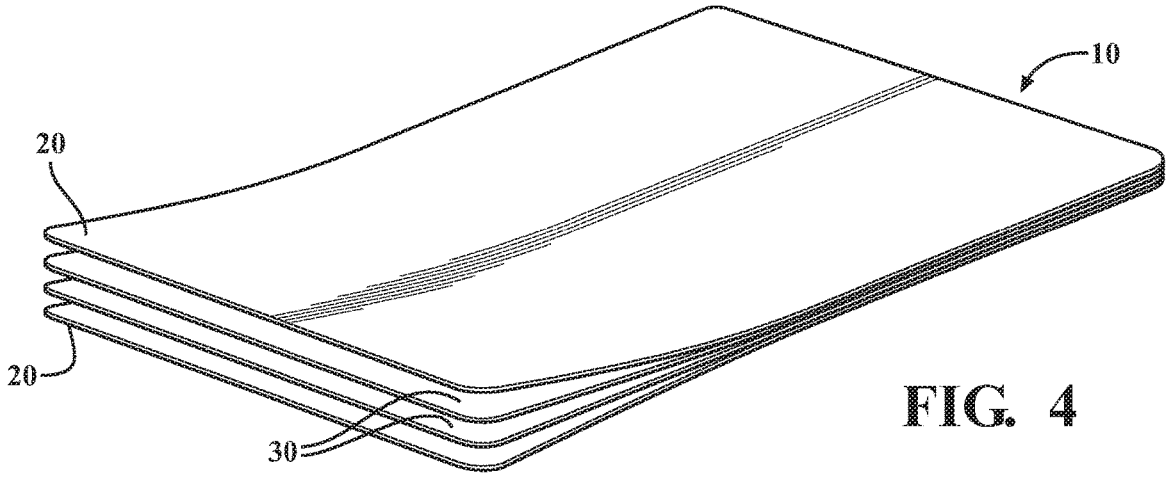
FIG. 4 is a pre-assembly view of the pouch of FIG. 1, representing either end prior to connecting ends of the inner and outer walls together.

FIG. 4 shows the four sheets or walls 20, 30 used to form the pouch of FIG. 1, prior to their ends being joined together to form the elongated interior compartment seal interfaces and end seals described above. The view in FIG. 4 can represent either end of the pouch prior to the four walls being joined.

Figure 5:
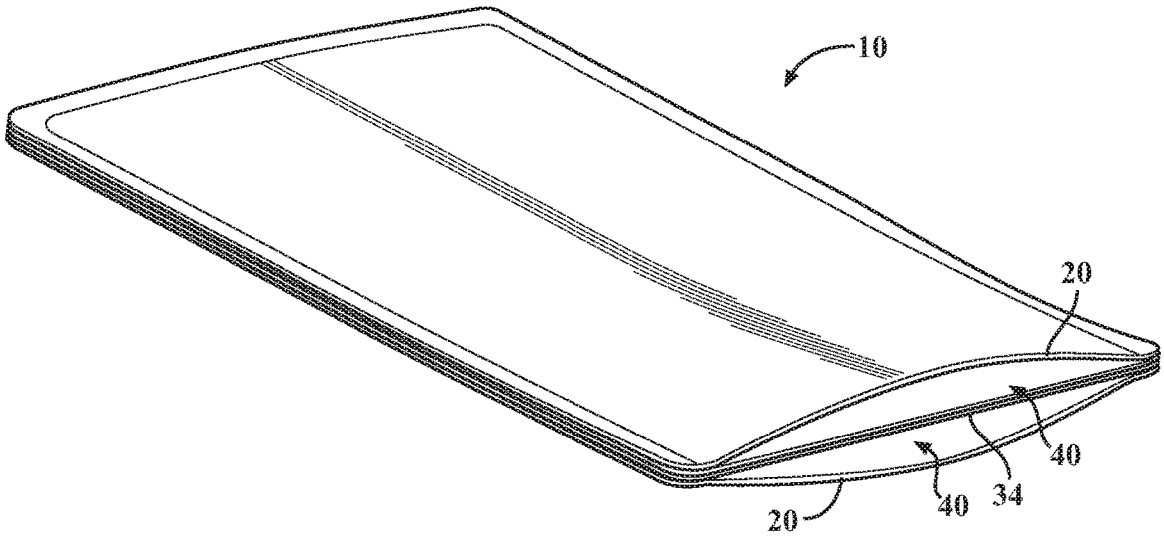
FIG. 5 is a perspective view of the pouch of FIG. 1, with the upper end removed to open two outer compartments.

FIG. 5 shows the upper end of pouch 10, with end seal 38 cut open or otherwise removed, exposing the two upper, outer compartments 40 so that their contents (shown in FIGS. 1 and 2 at A, B) can be removed.

Figure 6:
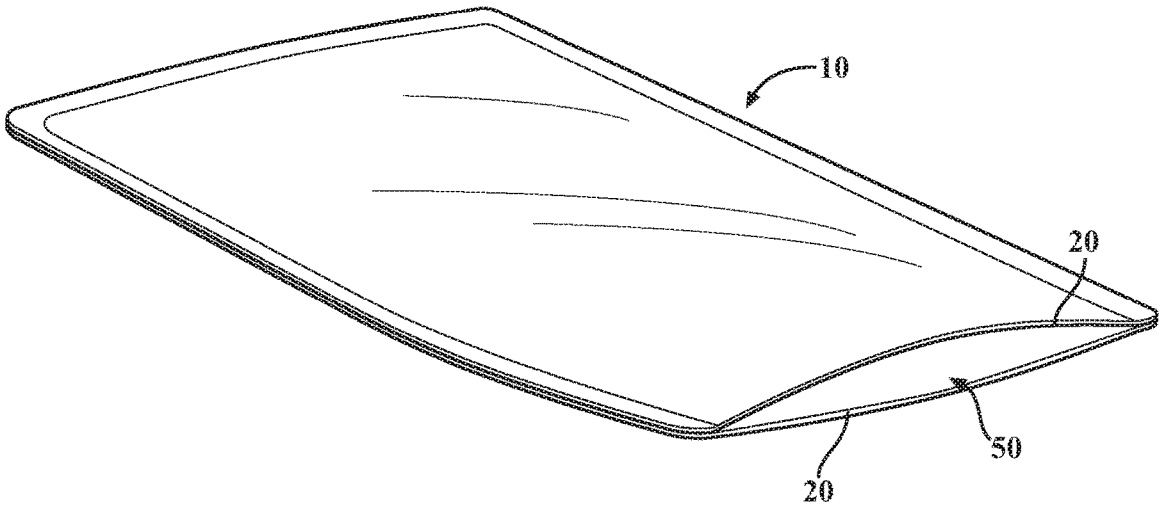
FIG. 6 is a perspective view of the pouch of FIG. 1, with the lower end removed to open an inner compartment.

FIG. 6 shows the lower end of pouch 10, with end seal 36 cut open or otherwise removed, exposing the lower, inner compartment 50 so that its contents (FIGS. 1 and 2 at C) can be removed.

Figure 7:
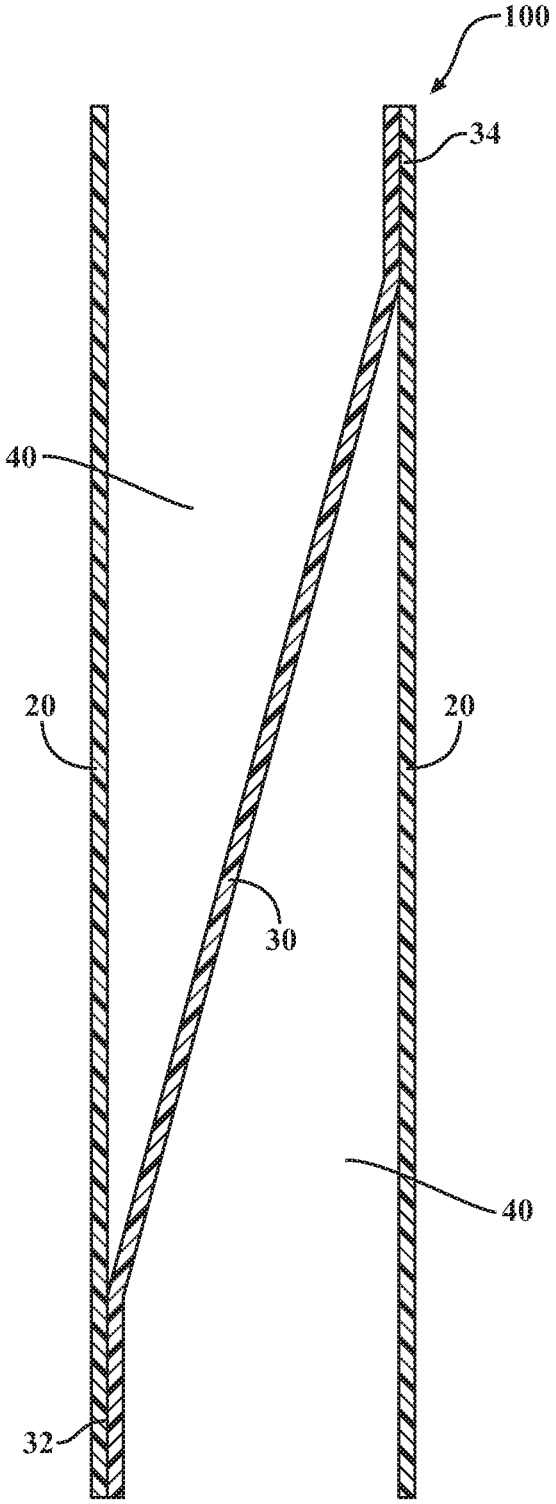
FIG. 7 is a side section view of a two-compartment pouch according to the invention.
Figure 8:
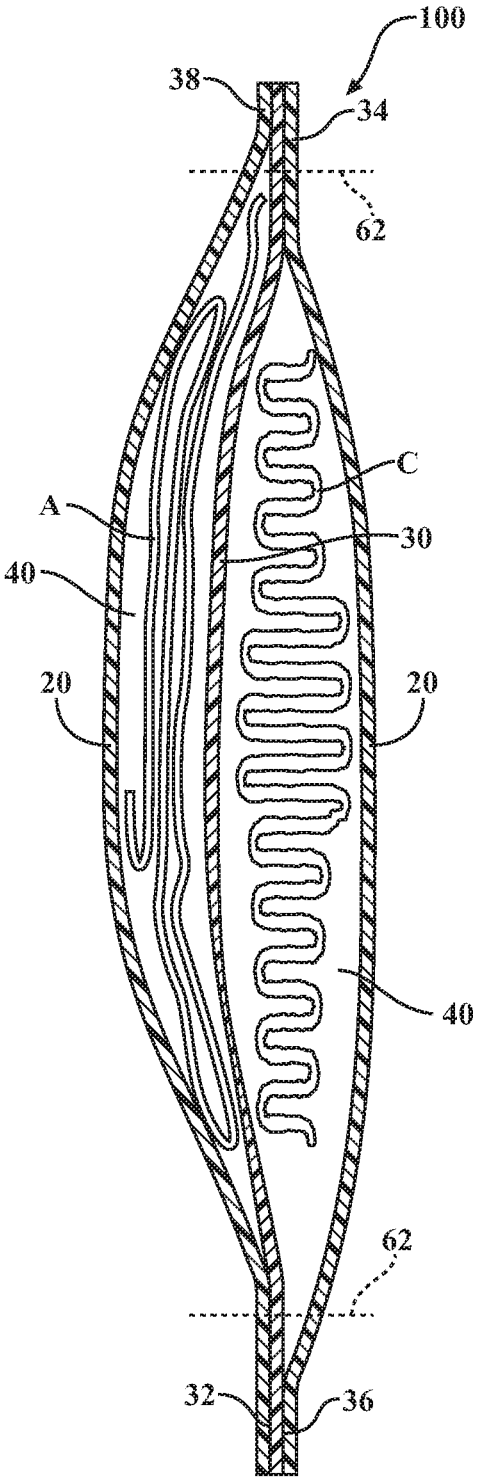
FIG. 8 is a similar to FIG. 7, but showing the upper and lower ends of the pouch sealed together.

Referring now to FIGS. 7 and 8, a two-compartment pouch 100 is shown. Pouch 100 has two outer walls 20 and a single diagonally connected divider wall 30 sealed at opposite ends to inner faces of the outer walls 20, defining upper and lower elongated seal interfaces to create two internal compartments 40 opening onto opposite ends of the pouch.

Compartments 40 may contain items such as A, C similar to those used in pouch 10 as shown in FIGS. 1 and 2, although in FIG. 8 the moistened towelette or wipe C is not independently packaged in foil, but inserted directly into compartment 40.

Referring specifically to FIG. 8, the lower and upper ends of pouch 100 are closed by end seals 36, 38 similar to those shown in FIGS. 1-2, each shorter end seal 36, 38 complementing an associated longer seal interface 32, 34 with a cut or tear line 62 positioned interiorly of the end seal but exteriorly (more toward the associated pouch end) of the interior wall junction where the longer interior compartment seal interfaces 32, 34 begin at the bottom of each respective compartment 40. Again, this ensures positive opening of the associated compartment end without destroying or fully separating the elongated seal interfaces 32, 34 that maintain the internal integrity of the compartments 40.

The filled, sealed pouches 10 and 100 shown in the drawings of FIGS. 1-2 and 7-8 are illustrated with an exaggerated front-to-back thickness and curvature of the compartments between the pouch outer walls, for ease of viewing and explanation. It will be understood that, depending on the contents, the pouches are capable of being produced in a much flatter configuration, for example by compressing the compartment contents, or evacuating air from the compartments as they are sealed.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. A multi-compartment pouch having upper and lower ends, the pouch comprising:

two outer walls and two inner divider walls, upper and lower ends of the outer walls being sealed to one another through respective upper and lower ends of the inner divider walls;

the upper end of the pouch comprising an upper opening feature extending across the upper end of the pouch, and the lower end of the pouch comprising a lower opening feature extending across the lower end of the pouch;

the inner divider walls defining an inner compartment therebetween with a lower openable end at the lower end of the pouch, and the inner divider walls and their respective outer walls defining outer compartments therebetween with upper openable ends at the upper end of the pouch;

the lower ends of the inner divider walls sealed to one another over a first shorter end seal region and further sealed over a first longer seal interface region to respective inside faces of the outer wall lower ends;

the upper ends of the inner divider walls sealed over a second shorter end seal region to respective inside faces of the outer wall upper ends; and, the inner divider wall upper ends further sealed to one another over a second longer seal interface region of greater length than the second shorter end seal region; wherein, the upper opening feature at the upper end of the pouch is located interiorly of the second shorter end seal region and exteriorly of a junction portion of the second longer seal interface region across the upper openable ends of the outer compartments, and the lower opening feature at the lower end of the pouch is located exteriorly of a junction portion of the first longer seal interface region and interiorly of the first shorter end seal region across the lower openable end of the inner compartment.

2. A multi-compartment pouch having upper and lower openable ends, comprising:

two outer walls and a first inner divider wall;

the first inner divider wall comprising upper and lower ends both sides of which are sealed to portions of upper and lower ends of the outer walls through a shorter end seal region and a longer interior compartment seal interface region on opposite sides of the first inner divider wall at each of the upper and lower openable ends of the pouch, forming first and second compartments one on each side of the first inner divider wall between the upper and lower openable ends of the pouch;

the upper and lower openable ends of the pouch each being independently openable across an opening feature extending thereacross, the opening feature located interiorly of the shorter end seal region and exteriorly of a junction portion of the longer interior compartment seal interface region associated with each of the upper and lower openable ends of the pouch, and further comprising a second inner divider wall between the first inner divider wall and a second one of the outer walls, wherein the second inner divider wall is sealed to the first inner divider wall at one end with the shorter end seal region and at an opposite end with the longer interior compartment interface seal region to form a third compartment between the second inner divider wall and the second one of the outer walls, and, wherein the second inner divider wall is sealed to the second one of the outer walls with a second longer interior compartment interface seal region opposite the shorter end seal region at one end and with a second shorter end seal region opposite the longer interior compartment interface seal region at the other end.

* * * * *